299-13 SR
5/8/79 XR 4,153,298

United States Patent [19] [11] 4,153,298
McCarthy et al. [45] May 8, 1979

[54] REMOVAL OF PILLARS FROM A VOID FOR EXPLOSIVE EXPANSION TOWARD THE VOID

[75] Inventors: Harry E. McCarthy, Golden, Colo.; Gordon B. French, Bakersfield, Calif.

[73] Assignee: Occidental Oil Shale, Inc., Grand Junction, Colo.

[21] Appl. No.: 840,906

[22] Filed: Oct. 11, 1977

[51] Int. Cl.[2] ..... E21C 41/10
[52] U.S. Cl. ..... 299/2; 166/259; 299/13
[58] Field of Search ..... 299/2, 13; 166/299, 166/259

[56] References Cited

U.S. PATENT DOCUMENTS

| | | | |
|---|---|---|---|
| 3,316,020 | 4/1967 | Bergstrom | 299/2 |
| 3,917,346 | 11/1975 | Janssen | 299/13 |
| 3,980,339 | 9/1976 | Heald et al. | 299/13 X |

*Primary Examiner*—Ernest R. Purser
*Attorney, Agent, or Firm*—Christie, Parker & Hale

[57] ABSTRACT

A subterranean formation containing oil shale is prepared for in situ retorting by initially excavating at least one void adjacent a zone of unfragmented formation to be expanded. The zone of unfragmented formation has a substantially horizontal free face adjoining the void. At least one support pillar of unfragmented formation is left in the void for supporting overlying formation. Explosive is placed in the zone of unfragmented formation, and in such a support pillar. Explosive in such a pillar and in the zone of unfragmented formation is detonated in a single round of explosions with a time delay between detonation of explosive in such a pillar and detonation of explosive in the zone of unfragmented formation for first expanding such a pillar toward the void and then expanding unfragmented formation toward the void. The time delay is sufficient for creation of free face at the juncture of such a pillar and the zone of unfragmented formation. The time delay is preferably short enough that explosive in the zone of unfragmented formation is detonated before particles formed by explosive expansion of the pillars have come to rest on the floor of the void. The fragmented permeable mass of formation particles so formed in an in situ oil shale retort is then retorted to recover shale oil from oil shale in the fragmented mass.

31 Claims, 3 Drawing Figures

REMOVAL OF PILLARS FROM A VOID FOR EXPLOSIVE EXPANSION TOWARD THE VOID

BACKGROUND OF THE INVENTION

This invention relates to the recovery of constituents from subterranean formations, and more particularly to an in situ method of recovery that is particularly effective for the production of shale oil from oil shale in an in situ oil shale retort. The term "oil shale" as used in the industry is in fact a misnomer; it is neither shale nor does it contain oil. It is a formation comprising marlstone deposit containing an organic material called "kerogen" which upon heating decomposes to produce carbonaceous liquid and gaseous products. It is the formation containing kerogen that is called "oil shale" herein, and the liquid product is called "shale oil."

The recovery of liquid and gaseous products from oil shale deposits has been described in several patents, one of which in U.S. Pat. No. 3,661,423, issued May 9, 1972, to Donald E. Garrett, assigned to the assignee of this application, and incorporated herein by this reference. This patent describes in situ recovery of liquid and gaseous carbonaceous materials from a subterranean formation containing oil shale by undercutting a portion of the subterranean formation leaving an overlaying deposit supported by a multiplicity of pillars. The pillars are removed, e.g., with explosive, and overlying deposit is expanded to provide a permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen supplying combustion zone feed into the retort on the trailing side of the combustion zone to advance the combustion zone through the fragmented mass. In the combustion zone oxygen in the gaseous feed mixture is depleted by reaction with hot carbonaceous materials to produce heat and combustion gas. By the continued introduction of the oxygen supplying feed into the combustion zone, the combustion zone is advanced through the fragmented mass. The effluent gas from the combustion zone passes through the retort on the advancing side of the combustion zone to heat the oil shale in a retorting zone to a temperature sufficient to produce kerogen decomposition, called retorting, in the oil shale to gaseous and liquid products and a residue of solid carbonaceous material. The resulting liquid and gaseous products pass to the bottom of the retort for collection.

It is desirable that the retort contain a reasonably uniformly fragmented, reasonably uniformly permeable mass of formation particles having a reasonably uniformly distributed void volume or void fraction so gases can flow uniformly through the retort and result in maximum converstion of kerogen to shale oil. A uniformly distributed void fraction in the direction perpendicular to the direction of advancement of the combustion zone is important to avoid channeling of gas flow in the retort. The creation of a mass of particles of uniform void volume distribution prevents the formation of over-sized voids or channels which hinder total recovery of shale oil and also provides a uniform pressure drop through the entire mass of particles. In preparation for the described retorting process, it is important that the formation and the support pillars be fragmented and displaced, rather than simply fractured, in order to create high permeability; otherwise, too much pressure differential is required to pass gas through the retort.

It has been proposed that oil shale be prepared for in situ recovery by first undercutting a portion of the formation to remove from about 5% to about 25% of the total volume of the in situ retort being formed. The overlying formation is then expended by detonating explosives placed in the formation to fill the void created by the undercut.

The general art of blasting rock formations is discussed in *The Blaster' Handbook,* 15th Edition, published by E. I. duPont de Nemours & Company, Wilmington, Delaware.

U.S. Pat. No. 3,434,757 issued to Prats describes detonation of explosive in arches between parallel tunnels in oil shale to create a large unsupported roof area that collapses into the tunnels. Additional formation is fragmented by sequential detonation of a series of explosives to form permeable zones in the oil shale, and hot fluid is passed through the permeable zones for producing shale oil.

Other methods for preparing formation for in situ recovery are described in U.S. Pat. Nos. 4,043,597 and 4,043,598, both assigned to the assignee of this invention, and both incorporated herein by this reference. According to these patents, at least two voids vertically spaced apart from each other are excavated in the subterranean formation. This leaves a zone of unfragmented formation between adjacent voids. Explosive is placed in blasting holes and detonated to expand formation in the intervening zone towards both voids.

U.S. Pat. No. 3,980,339 to Heald et al describes mining out an area at the base of an oil shale deposit leaving overlying deposit supported by a plurality of pillars. The pillars are removed with explosive and overlying formation is expanded into the underlying area with explosives. The disclosure of this patent, particularly that relating to the removal of support pillars with explosive, is incorporated herein by this reference.

Copending U.S. Patent Application Ser. No. 833,240 filed Sept. 14, 1977, by Gordon B. French, titled EXPLOSIVE PLACEMENT FOR EXPLOSIVE EXPANSION TOWARD SPACED APART VOIDS, which is assigned to the Assignee of the present application, describes a method for forming an in situ oil shale retort by expanding formation toward vertically spaced apart voids containing support pillars. The pillars are explosively expanded to spread the particles thereof uniformly across the void, and unfragmented formation adjacent the void is explosively expanded toward the void before overlying, unsupported formation can cave into the void. Said U.S. Patent Application Ser. No. 833,240 is incorporated herein by this reference.

SUMMARY OF THE INVENTION

The present invention in one embodiment provides a method for fragmenting a subterranean formation to form a fragmented, permeable mass of formation particles by first excavating at least one void adjacent a zone of unfragmented formation to be explosively expanded. The surface of the zone of unfragmented formation adjacent such a void provides a generally horizontal free face. At least one support pillar of unfragmented formation is left in such a void for supporting overlying formation. A zone of unfragmented formation to be explosively expanded can be above the void or below the void. Zones of unfragmented formation to be explosively expanded toward such a void can be both above and below such a void. Explosive is placed in such a zone of unfragmented formation. Sufficient explosive is also placed in such a support pillar to fragment and explosively expand substantially the entire pillar and to distribute the particles of pillar thus formed reasonably uniformly across at least a portion of the void.

Such explosive is detonated in a single round of explosions with a time delay between detonation of explosive in such a pillar and detonation of explosive in such a zone of unfragmented formation. A minimum time delay is the length of time required for creation of free face at the original juncture of the pillar with the zone of unfragmented formation to be expanded. A useful time delay can be less than the time required for a substantial portion of particles formed by explosive expansion of the pillar to come to rest on the bottom or floor of the void. A useful time delay can be about the length of time required for particles formed by explosive expansion of the pillar to spread substantially uniformly across at least a portion of the void while remaining in motion above the bottom of the void, so that particles of pillar in flight are stopped by explosive expansion of the zone of unfragmented formation. A desirable time delay can be about the length of time required for the expanding piller to attain a void fraction no more than about the average void fraction of the fragmented permeable mass of particles being formed, so that expansion of the pillar is stopped by explosive expansion of the zone of unfragmented formation. The time delay is less than the time required for overlying formation to collapse into the void after expansion of the pillar.

Explosive can be placed in the zone of unfragmented formation by forming a plurality of generally vertical blasting holes in the unfragmented zone and placing explosive in such blasting holes. Explosive can be placed in the pillar by forming at least one generally horizontal blasting hole, preferably aligned with the longer horizontal dimension of the pillar to be expanded and placing explosive therein for fragmenting and expanding the pillar.

DRAWING

These and other aspects of the invention will be more fully understood by reference to the following detailed description and accompanying drawings in which.

DETAILED DESCRIPTION OF THE INVENTION

Figure 1:
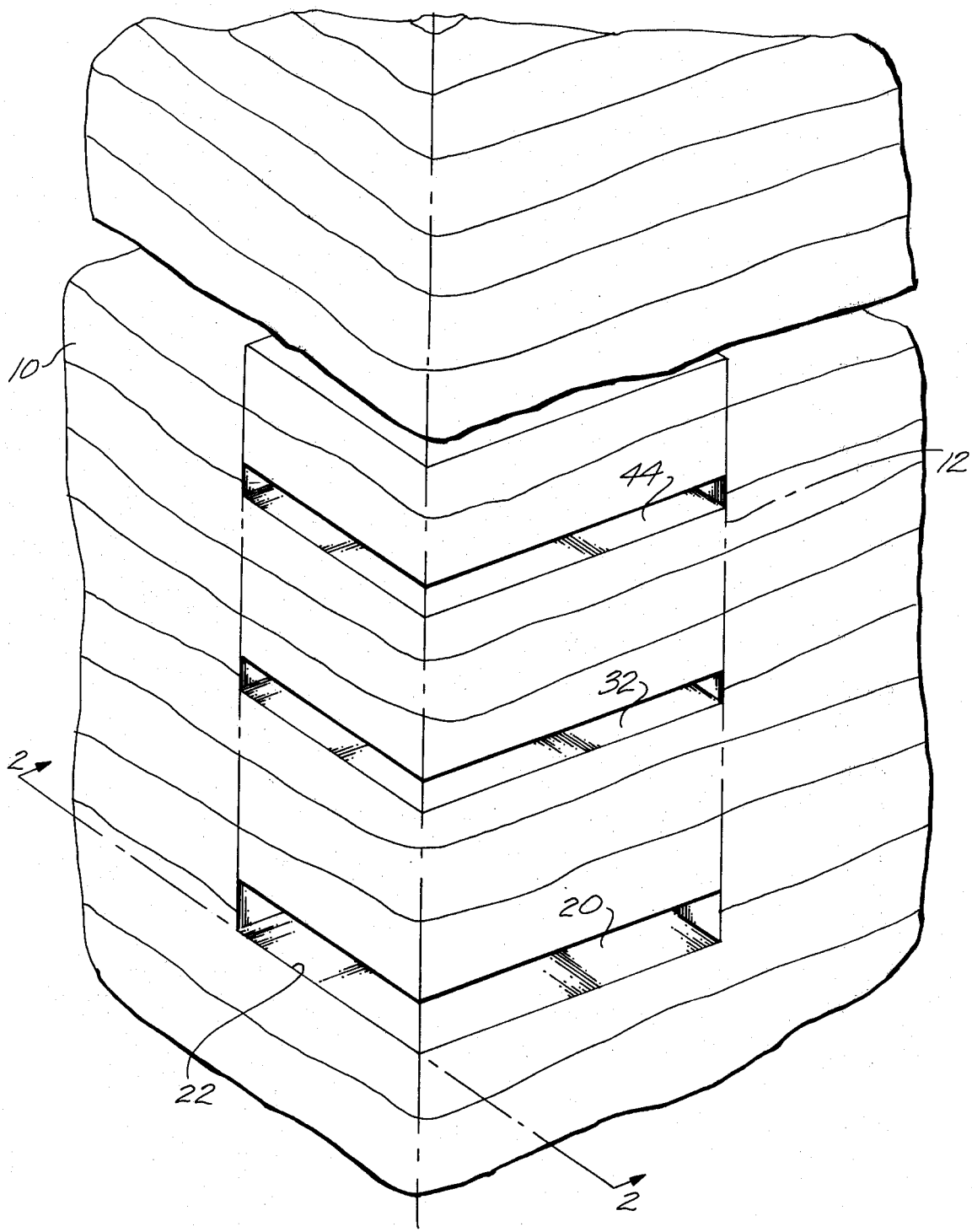
FIG. 1 is a schematic perspective view showing a subterranean formation containing oil shale in an intermediate stage of preparation for in situ recovery.
Figure 2:
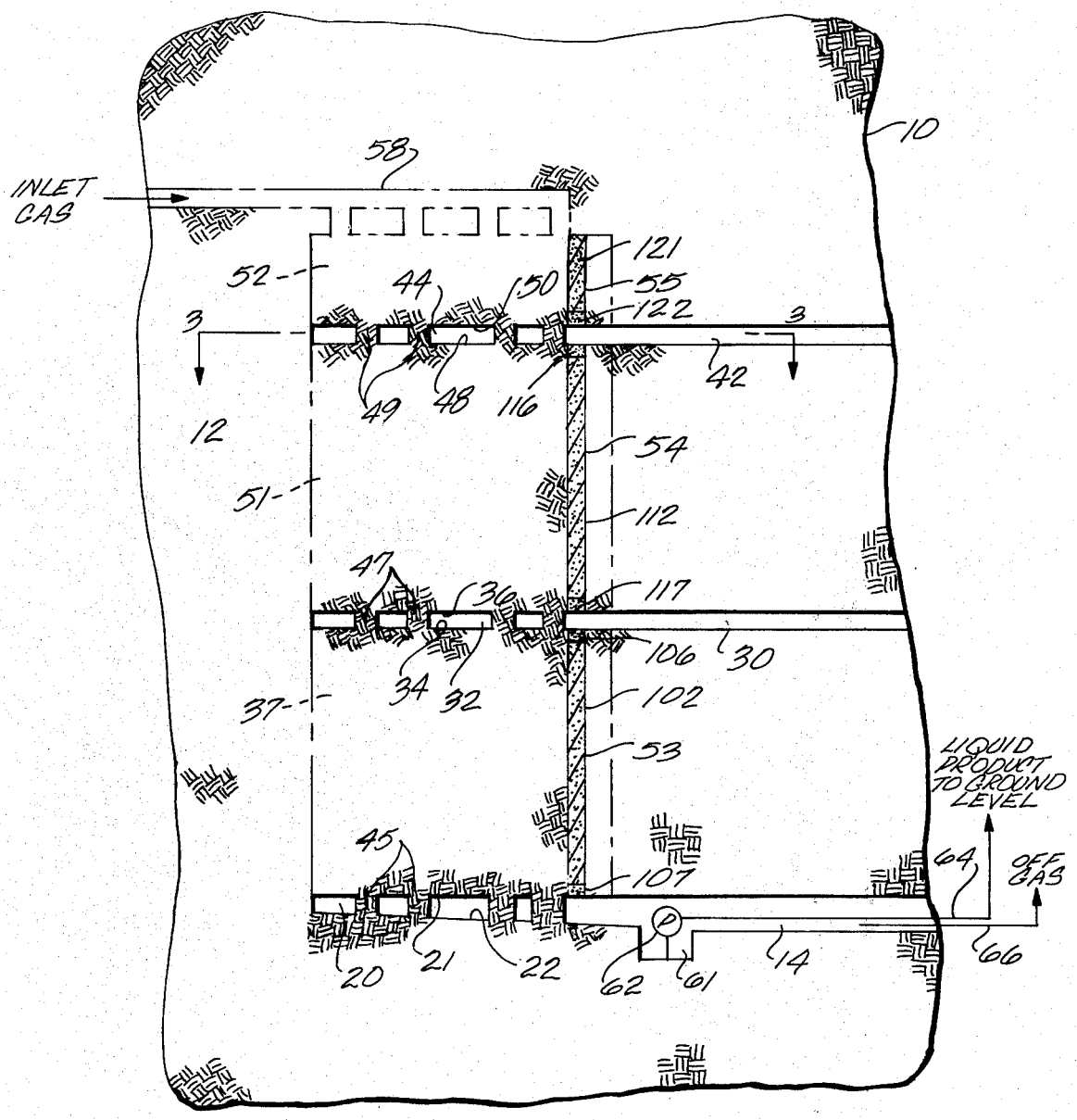
FIG. 2 is a schematic cross-sectional elevation view taken on line 2—2 of FIG. 1 showing pillars in the voids.
Figure 3:
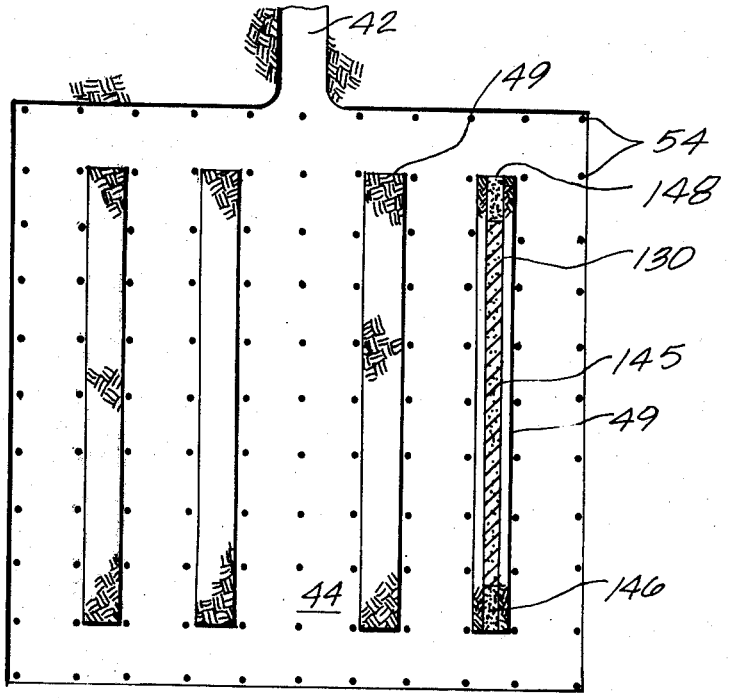
FIG. 3 is a cross-sectional plan view taken on line 3—3 of FIG. 2 showing a blasting hole in a pillar.

FIGS. 1-3 illustrates a subterranean formation 10, such as a subterranean formation containing oil shale, which is in an intermediate stage of preparation for in situ recovery of carbonaceous values such as shale oil and hydrocarbon gaseous products. Generally speaking, in situ recovery is carried out by initially excavating formation from a portion of the subterranean formation leaving support pillars, fragmenting and explosively expanding the pillars, and then explosively expanding a remaining portion of the formation to produce a fragmented permeable mass of formation particles containing oil shale. The present invention is described in the context of a method for ultimately producing a subterranean retort comprising an approximately rectangularly prismatic retort cavity, or room 12 (illustrated in phantom lines in FIGS. 1-3) containing a reasonably uniformly fragmented, reasonably uniformly permeable mass of expanded formation particles having a reasonably uniformly distributed void fraction for economical retorting operations. In the illustrated embodiment, the in situ retort being formed is square in horizontal cross-section having a vertical dimension or height which is greater than its maximum lateral dimension or width. The height of the retort can be less than or the same as the width of the retort.

Referring to FIG. 2, access to the portion of the subterranean formation containing oil shale to be expanded is established by forming a horizontal tunnel, drift or adit 14 extending to the bottom of the volume to be expanded. From the drift 14, a portion of the formation is undercut and a volume of formation is removed to form a lower void 20 at the bottom of the subterranean retort 12 to be formed. The material excavated from the lower void is hauled away through the drift 14 for removal to the surface via a shaft or adit (not shown).

Formation overlying the lower void 20 defines a horizontal free face 21 of the formation immediately above the lower void. One or more pillars 45 of unfragmented formation are left in the lower void to help support overlying formation as described in greater detail hereafter. The floor plan or horizontal cross-section of the lower void 20 can be generally square, although the void, and also the in situ retort to be formed, can be of other horizontal cross-section such as rectangular, without departing from the scope of the invention. The floor 22 of the lower void is inclined downwardly in the direction of the drift 14 to facilitate the flow of shale oil in the direction of the drift during subsequent retorting operations.

A horizontal access tunnel or drift 30 is excavated at an elevation above the elevation of the bottom void 20. From the horizontal access drift 30, formation is excavated from the volume to be expanded to form an intermediate void 32 at an elevation above the elevation of the lower void 20. The horizontal cross-section of the intermediate void 32 substantially matches the horizontal cross-section and area of the lower void 20 and the in situ retort 12 to be formed. Thus, the intermediate void can be square or rectangular in shape, and preferably is substantially directly above the lower void so the outer edges of the two voids lie in common vertical planes. One or more pillars 47 are left in the intermediate void to support the overlying formation. The formation adjacent the intermediate void defines a pair of vertically spaced apart, bottom and top horizontal free faces 34 and 36, respectively, adjoining the intermediate void 32. The two voids 20 and 32 also define a lower intervening zone 37 of unfragmented formation containing oil shale left within the boundaries of the subterranean retort 12 between the substantially parallel horizontal free faces 21 and 34.

A horizontal tunnel or drift 42 is excavated at an elevation above the elevation of the intermediate void 32. Formation is removed from within the boundaries of the retort 12 being formed through the drift 42 to form an upper void 44 at an elevation above the elevation of the intermediate void 32. The horizontal cross-section of the upper void 44 is substantially similar to the cross-section of the lower and intermediate voids of the retort 12. The upper void preferably is aligned with the voids below it so that the outer edges of the upper void lie in common vertical planes with the outer edges of the voids below. The upper void 44 is approximately the same height as the intermediate void 32. One or more pillars 49 of unfragmented formation are left in the upper void to help support the overlying formation as shown in FIGS. 2 and 3 (not shown in FIG. 1). Preferably, the pillars in all the voids are at least as wide as they are high to maximize the stability of the overlying formation. The proportion of formation extracted from the void and proportion temporarily left in the form of pillars of unfragmented formation depends on many factors such as rock properties, depth of overburden, height of the void, time the void must remain open and the like. The size and location of pillars is readily determined by conventional techniques by one skilled in mining.

The upper void defines a pair of vertically spaced apart bottom and top horizontal free faces 48 and 50, respectively, of the unfragmented formation adjoining the void. The two voids 32 and 44 also define an upper intervening zone 51 of unfragmented formation left between the free faces 36 and 48. An unfragmented zone 52 of unfragmented formation within the boundaries of the retort being formed is also left above the uppermost free face 50.

The technique for expanding oil shale illustrated in the drawings has one intermediate void between an upper void and a lower void. In other techniques, according to this invention, there can be only one void, or two voids with no intermediate void, or there can be two or more intermediate voids one above another. The total number of voids used depends upon the height of the formation to be expanded. The greater the height of the formation to be expanded, the more voids required.

Multiple intermediate voids can be useful where the height of the retort being formed is very much larger than its width. One or two intermediate voids can be excavated between the top and bottom voids so that the in situ retort can have a substantial height without need for expanding excessively thick zones of formation between adjacent voids.

Conventional underground mining techniques and equipment are used for excavating the voids and access drifts.

After the spaced apart voids have been excavated in the formation, the intervening zones 37, 51 of unfragmented formation, the zone 52 of unfragmented formation above the upper void 44, and the support pillars 45, 47, and 49 are prepared for explosive expansion and subsequent retorting operations. A plurality of vertical blasting holes 53 are drilled in the lower intervening zone 37 upwardly from the lower void 20 or downwardly from the intermediate void 32. Similarly, a plurality of vertical blasting holes 54 are drilled in the upper intervening zone 51 from the intermediate void 32 or the upper void 44, and a plurality of vertical blasting holes 55 are drilled upwardly from the upper void 44 into the zone 52 of unfragmented formation above the upper void. One of each such vertical blasting holes 53, 54, and 55 is shown in FIG. 2. To show placement of loads of explosive 102, 112, and 121 and stemming 122, 116, 117, 106, and 107 in these blasting holes, they are shown out of proportion in FIG. 2, i.e., the diameter of the vertical blasting holes is much smaller in relation to the dimensions of the retort 12 than shown in FIG. 2. The horizontal blasting hole 130, explosive 145, and stemming 146 and 148 shown in FIG. 3 are also shown out of proportion. Details of such loads of explosive, stemming, and sequence of detonation are provided in Patent Application Ser. No. 833,240 mentioned above.

Horizontally extending blasting holes are drilled in the pillars 45, 47, and 49, for explosive expansion of the pillars. FIG. 3 shows one such horizontal blasting hole 130 drilled parallel to the longer horizontal dimension of the pillar 49 and containing explosive 145 and stemming 146 and 148. The actual number, size, and spacing of the horizontal blasting holes are dependent on the size and shape of the pillars, the explosive used, etc. What is required is that sufficient explosive be placed in the pillars to fragment and explosively expand substantially all of each pillar. The details can readily be determined in accordance with conventional blasting techniques. Another pattern of blasting holes for explosive removal of support pillars is illustrated in FIGS. 2 and 3 of the above-mentioned U.S. Pat. No. 3,980,339 to Heald et al.

It should be understood that in the illustrated version of this invention there are a plurality of vertical blasting holes in the zones of unfragmented formation, and a plurality of horizontal blasting holes in the support pillars. Only a representative blasting hole is illustrated for clarity. The size and total number of blasting holes used is that which provides sufficient total explosive energy to expand and fragment the formation being blasted. FIG. 3 shows an exemplary arrangement which can be used for placement of blasting holes 54 in the upper intervening zone 51 of unfragmented formation. Many variations are also useful.

Explosive in the pillars 45, 47, and 49 of unfragmented formation left in the voids is detonated before detonating explosive in the blasting holes in the zones of unfragmented formation so the pillars do not interfere with explosive expansion of the zones of unfragmented formation. Thus, explosive in the upper intervening zone 51 is not detonated until after creation of a free face at the junctures of the pillars 49 in the upper void and the pillars 47 in the intermediate void 32 with the upper intervening zone 51 by detonation of explosive in the pillars.

After the pillars are explosively fragmented, caving of formation supported by the pillars can occur. Since such caving can interfere with explosive expansion of the overlying zone of unfragmented formation 52 toward the upper void 44 and with upward expansion of formation in the underlying zone of unfragmented formation 51 toward the upper void 44, explosive in the upper intervening overlying zone 52 is detonated before caving of the formation previously supported by the pillars. To this same effect, explosive in the underlying zone 51 is detonated before caving of formation previously supported by the pillars, for example, at about the same time as explosive in the overlying zone 52 is detonated.

In this regard it can be noted that caving of formation previously supported by pillars is time dependent. The start and progress of caving depends on the properties of the formation, its depth and the unsupported span. In some cases many seconds can elapse between removal of pillars and caving of overlying formation.

To obtain a uniform distribution of formation in a void containing pillars, preferably explosive in an unfragmented zone below and/or above the void is not detonated until after pillar fragments from explosively expanding the pillars in the voids are uniformly distributed. Thus, preferably the explosive in the upper intervening zone 51 and the explosive in the zone 52 above the upper void are not detonated until after pillar fragments resulting from fragmenting the pillars 49 in the upper void are substantially uniformly distributed in the upper void 44.

Pillar fragments are substantially uniformly distributed across the void as the phrase is used herein when they are still in flight after explosive expansion of the pillar, i.e., when the pillar is still expanding, and have velocity and position such that pillar fragments are substantially uniformly distributed in a substantially horizontal zone of particles in the fragmented mass of particles formed by explosive expansion of the pillar or pillars and the adjacent zone or zones of unfragmented formation. When there is only one pillar in a void, fragments of the pillar after expansion will be substantially uniformly distributed in a horizontal zone extending across the fragmented mass. When a plurality of pillars are in the void, fragments from the pillars can be commingled and uniformly distributed in such a horizontal zone extending across the fragmented mass, or fragments from a particular pillar can be uniformly distributed in a portion of such a horizontal zone corresponding to the original location of that pillar.

Thus, for example, the explosive in the zones of unfragmented formation 51 and 52 is detonated after a time delay sufficient for particles from each pillar 49 to spread substantially uniformly across at least a portion of the void adjacent to the original position of each pillar. The time delay can be such that pillar fragments are stopped in flight by explosive expansion of the zones of unfragmented formation before fragments from one pillar become substantially commingled with particles from an adjacent pillar.

It is important in the practice of this invention to avoid leaving a stump in a void either extending from a zone of unfragmented formation to be expanded or opposite such a zone of unfragmented formation upon explosive expansion of a pillar in the void. Such a stump can interfere with the uniform explosive expansion of a zone of unfragmented formation toward the void. By "stump" is meant a portion of a pillar remaining after explosive expansion of the pillar. A stump can extend from the bottom to the top of a void, in effect a smaller pillar, or it can extend down from the top or up from the bottom of the void and terminate within the void. Both types of stump are undesirable. Sufficient explosive is therefore placed in a pillar to be expanded to fragment and expand substantially all of the pillar, thereby avoiding leaving either type of stump in the void.

Sufficient explosive is placed in such a pillar to expand substantially all of the pillar to have an average void fraction at least as great as the average void fraction in the fragmented mass being formed. Sufficient amount of explosive can be placed in such a pillar to expand substantially all of the pillar to have an average void fraction greater than the average void fraction in the fragmented mass being formed, and overexpansion of such a pillar upon detonation of the explosive can be stopped by explosive expansion of a zone of unfragmented formation as elsewhere described herein.

Thus, there is a controlled time delay between the detonating of explosive in the pillar or pillars contained in a void and the detonation of explosive in a zone of unfragmented formation adjacent the void for expanding such formation toward the void. The pillars and the zone or zones of unfragmented formation adjacent the void are expanded by detonation of the explosive in a single round of explosions for first expanding the pillars and then expanding the zone of unfragmented formation toward the void.

A minimum time delay is the length of time required for creation of free face at a juncture of such a pillar with such a zone of unfragmented formation to be expanded owing to explosive expansion of such a pillar. Only minimal expansion of such a pillar is required for the creation of free face at the former juncture of such a pillar and such a zone of unfragmented formation. The time required can be less than one second, for example on the order of about 50 to 250 milliseconds. The exact time when free face is formed depends upon the formation being expanded, the nature, quantity and distribution of explosive, the time delays, if any, in detonating explosive in the pillars, and the like. The time delay between detonating explosive in the pillars and detonating explosive in the zone of unfragmented formation is preferably more than the length of time required for formation of free face at the junctures to assure that geologic inhomogenieties, explosive variations and the like can be accomodated.

A maximum time delay is less than the length of time required for a substantial portion of the pillar fragments formed by expansion of the pillars to come to rest on the bottom of the void. thus, explosive in the zone or zones of unfragmented formation is detonated while a substantial portion of the pillar fragments are still in midair.

Initiating the expansion of formation toward the void before the pillar particles come to rest is particularly advantageous when underlying formation is being expanded upwardly toward the void. When the pillar fragments are permitted to come to rest on the free face of the underlying formation, they can interfere with expansion of underlying formation in two ways. Similarly, when overlying formation is permitted to cave after removal of pillars, the fragments of overlying formation that fall to the free face of underlying formation can interfere with expansion of underlying formation. First, when explosive is detonated in the underlying formation, a compression wave travels through the formation to the free face thereof adjoining the void. At the free face, the compression wave is reflected back into the formation as a tension wave that initiates spalling and fragmentation at the free face. The stress wave is reflected because of a mismatch of properties at the free face. For example, the wave velocity in unfragmented formation is much different from velocity in air. When pillar fragments are on the free face, the mismatch can be decreased and less energy is reflected. In other words, pillar fragments resting on the free face absorb part of the compression wave, thereby lessening the intensity of the tension wave and, consequently, the extent of fracturing obtained. Second, the pillar fragments must be lifted by the expanding underlying formation, thus lessening the energy available for expansion of formation. As a result, significantly greater quantities of explosive can be required to effect expansion of the underlying formation than would be required in the absence of fragments resting on the free face. Thus, by expanding underlying unfragmented formation before caving of overlying formation after removal of pillars, or before pillar fragments formed by explosive expansion of pillars have come to rest, more efficient use of explosive and greater uniformity of void fraction in the resultant fragmented mass can be achieved.

Detonation of explosive in overlying formation to initiate expansion thereof before the pillar fragments come to rest on the bottom of the void can also provide advantages. For example, the desired void fraction in a fragmented permeable mass of particles in an in situ oil shale retort is between about 10 and 25 percent, but a loose pile of oil shale rubble can have a void fraction of about 30 percent or more. Once the pillar fragments have fallen to the bottom of the void in a loose pile, it will be difficult or impossible to compact them to the desired void fraction with a reasonable quantity of explosive. By expanding overlying formation while the pillar fragments are still moving, the expanding, overlying formation can prevent overexpansion of the pillar fragments.

To avoid overexpansion of the pillar fragments, it is preferred to have a time delay no longer than the length of time required for the expanding pillars to expand to an average void fraction no more than about the average void fraction desired in the fragmented permeable mass being formed. This time is longer than the time required for creation of free face at the junctures of the pillars and the zones of unfragmented formation and shorter than the time required for a substantial portion of the pillar fragments to come to rest. Given the number of geometric, geologic and explosive variables involved, this time cannot be stated for all cases. The optimum time delay for a given situation can be determined by conducting test expansions of pillars under field conditions and observing the result with high speed motion picture cameras and/or measurements of the rubble produced.

The distributed void fraction or void volume of the permeable mass of particles in the retort, i.e., the ratio of the volume of the voids or spaces between particles to the total volume of the fragmented permeable mass of particles in the subterranean in situ retort 12, is controlled by the volume of the excavated voids into which the formation is expanded. Preferably, the total volume of the excavated voids is sufficiently small compared to the total volume of the retort that the expanded formation is capable of filling the voids and the space occupied by the expanded formation prior to expansion. In other words, the volume of the voids is sufficiently small that the retort is full of expanded formation. In filling the voids and the space occupied by the zones of unfragmented formation (including pillars) prior to fragmentation, the particles of the expanded formation become jammed and wedged together tightly so they do not shift or move after fragmentation has been completed. In numerical terms, the total volume of the voids is preferably less than about 30% of the total volume of the retort being formed. In one embodiment of this invention, the volume of the voids is preferably not greater than about 25% of the volume of the retort being formed, as this is found to provide a void fraction in the fragmented formation containing oil shale adequate for satisfactory retorting operation. If the void fraction is more than about 25%, an undue amount of excavation occurs without concomitant improvement in permeability. Removal of the material from the voids is costly, and kerogen contained therein is wasted or retorted by costly above ground methods.

The total volume of the excavated voids is also sufficiently large compared to the total volume of the retort that substantially all of the expanded formation within the retort is capable of moving enough during explosive expansion to fragment and for the fragments to be displaced and/or reoriented. Such movement provides permeability in the fragmented mass to permit flow of gas without excessive pressure requirements for moving the gas. When the fragmented particles containing oil shale are retorted, they increase in size. Part of this size increase is temporary and results from thermal expansion, and part is permanent and is brought about during the retorting of kerogen in the shale. The void fraction of the fragmented permeable mass of shale particles should also be large enough for efficient in situ retorting as this size increase occurs. In numerical terms, the minimum volume of the voids in view of the above considerations is preferably above about 10% of the total volume of the retort. Below this average percentage value, an undesirable amount of power is required to drive the gas blowers causing retorting gas to flow through the retort.

The above percentage values assume that all of the formation within the boundaries of the retort is to be fragmented; that is, there are no unfragmented regions left in the retort. If there are unfragmented regions left within the outer boundaries of the retort, e.g., for support pillars or the like, the percentages would be less.

The explosive in all of the pillars in a void can be detonated substantially simultaneously, and explosives in the zone of unfragmented formation adjacent the void can be detonated substantially simultaneously after the selected time delay. If desired to avoid excess seismic shock, the pillars can be fragmented sequentially in a desired pattern, e.g., from one side of the void to the other or from the center outward, and the unfragmented formation can be expanded in a similar pattern, allowing the selected time delay between fragmentation of a given pillar and expansion of formation immediately adjacent that pillar. In a similar manner, when a plurality of vertically spaced apart voids containing support pillars are used, the fragmentation of pillars and expansion of formation toward each void can be done sequentially in a single round of explosions to form a fragmented permeable mass of particles.

Following explosive expansion of the formation to form a fragmented mass of formation particles in the retort 12, at least one gas access communicating with an upper level of the fragmented mass is established by forming a horizontal tunnel 58 and a plurality of communicating vertical conduits 60 to the top of the fragmented permeable mass of expanded formation contained in the retort.

The recovery of shale oil and gaseous products from the oil shale in the retort generally involves the movement of a retorting zone through the fragmented permeable mass of formation particles in the retort. The retorting zone can be established on the advancing side of a combustion zone in the retort or it can be established by passing heated gas through the retort. It is generally preferred to advance the retorting zone from the top to the bottom of a vertically oriented retort, i.e., a retort having vertical side boundaries. With this orientation, the shale oil and product gases produced in the retorting zone move downwardly toward the base of the retort for collection and recovery aided by the force of gravity and gases introduced at an upper elevation.

A combustion zone can be established at or near the upper boundary of a retort by any of a number of methods. Reference is made to application Ser. No. 776,234, filed Mar. 9, 1977 and assigned to the assignee of the present application, and incorporated herein by this reference for one method in which an access conduit 58 is provided to the upper boundary of the retort and a combustible gaseous mixture is introduced therethrough and ignited in the retort. Off gas is withdrawn through an access means such as the drift 14 extending to the lower boundary of the retort, thereby bringing about a movement of gases from top to bottom of the retort through the fragmented permeable mass of formation particles containing oil shale. A combustible gaseous mixture of a fuel, such as propane, butane, natural gas, or retort off gas, and air is introduced through the access conduit 58 to the upper boundary and is ignited to initiate a combustion zone at or near the upper boundary of the retort. Combustible gaseous mixtures of oxygen and other fuels are also suitable. The supply of combustible gaseous mixture of the combustion zone is maintained for a period sufficient for the oil shale at the upper boundary of the retort to become heated, usually to a temperature of greater than about 900° F. so combustion can be sustained by the introduction of air without fuel gas into the combustion zone. Such a period can be from about one day to about a week in duration.

The combustion zone is sustained and advanced through the retort toward the lower boundary by introducing an oxygen containing retort inlet mixture through the access conduit 58 to the upper boundary of the retort, and withdrawing gas from below the retorting zone. The inlet mixture, which can be a mixture of air and a diluent such as retort off gas or water vapor, can have an oxygen content of about 10% to 20% of its volume. The retort inlet mixture is introduced to the retort at a rate of about 0.5 to 2 standard cubic feet of gas per minute per square foot of cross-sectional area of the retort.

The introduction of gas at the top and the withdrawal of off gases from the retort at a lower elevation serve to maintain a downward pressure differential of gas to carry hot combustion product gases and non-oxidized inlet gases (such as nitrogen, for example) from the combustion zone downwardly through the retort. This flow of hot gas establishes a retorting zone on the advancing side of the combustion zone wherein particulate fragmented formation containing oil shale is heated. In the retorting zone, kerogen in the oil shale is retorted to liquid and gaseous products. The liquid products, including shale oil, move by gravity toward the base of the retort where they are collected in a sump 61 and pumped to the surface by a pump 62 through a liquid product transfer line 64. The gaseous products from the retorting zone mix with the gases moving downwardly through the in situ retort and are removed as retort off gas from a level below the retorting zone. The retort off gas is the gas removed from such lower level of the retort and transferred to the surface via a gas product transfer line 66. The off gas includes retort inlet mixture which does not take part in the combustion process, combustion gas generated in the combustion zone, product gas generated in the retorting zone, and carbon dioxide from decomposition of carbonates contained in the formation.

This invention can be practiced to advantage whenever support pillars are left in a subterranean void excavated in preparation for explosive expansion. Thus, the terms "substantially horizontal" and "substantially vertical" as used herein are intended to include significant deviations from the horizontal or vertical. For example, if the free face of a zone of formation is sufficiently horizontal to require the support of a pillar, it is considered to be substantially horizontal as the term is used herein.

The term "pillars" as used herein is intended to include both a pillar which adjoins a void on all sides of the pillar and a pillar which adjoins a void at a portion of its periphery and which adjoins unfragmented formation at a portion of its periphery as well as at its top and bottom. A pillar of the latter type can have, for example, a square or rectangular horizontal cross-section and have two or three vertical faces adjoining a void. Such a pillar can extend into a void from a side wall of the void, or it can occupy what would otherwise be a corner of the void. In other words, such a pillar is attached to one or two side walls of the void as an integral part thereof.

One or more pillars are left in the void. The pillar or pillars preferably occupy up to about 30 percent of the volume contained within the outer dimensions of the void. In other words, the volume of the pillars is up to about 3/7 of the volume of void actually excavated. This proportion of pillar to void gives good support to overlying formation and provides adequate void volume for expansion of the pillars and formation from the zone of unfragmented formation toward the void.

In an embodiment of this invention, a void is excavated adjacent an underlying zone of unfragmented formation to be expanded upwardly toward the void. At least one pillar of unfragmented formation is left in the void for supporting overlying formation. Explosive is placed in such pillar and in the zone of unfragmented formation. Explosive in such a pillar is detonated for explosively expanding the pillar. Explosive in the underlying zone of unfragmented formation is detonated after a time delay at least as long as the time required for creation of a free face at the juncture of the pillar and the underlying zone of unfragmented formation but shorter than the time required for caving of overlying formation caused by removal of the pillar.

In an embodiment of this invention, a void is excavated in a subterranean formation containing oil shale leaving vertically spaced apart upper and lower zones of unfragmented formation, each of said zones of unfragmented formation having a substantially horizontal free face adjoining the void. At least one support pillar of unfragmented formation is left in the void for supporting the upper zone of unfragmented formation. Each such support pillar meets each of the zones of unfragmented formation at a juncture of such a pillar and such a zone of unfragmented formation. Explosive is placed in such a pillar and in the upper and lower zones of unfragmented formation for expanding unfragmented formation toward the free face of each zone, thus toward the void. Explosive in such a pillar is detonated and after such a time delay explosive in the upper and lower zones of unfragmented formation is detonated for expanding the upper and lower zones of unfragmented formation toward the void.

In an embodiment of this invention a plurality of vertically spaced apart voids are excavated, each containing at least one support pillar. Explosive in the support pillars is detonated and explosive in a zone of unfragmented formation between the voids is detonated after such a time delay for expanding the zone of unfragmented formation both upwardly and downwardly toward such voids.

The above described use of the invention for recovering carbonaceous values including shale oil from subterranean formation containing oil shale is for illustrative purposes. The invention can also be used in a variety of instances where is is desirable to prepare a subterranean ore formation for in situ recovery where the particle size and subsequent void volume distribution of the ore particles are to be controlled to maximize the recovery of constituents from the formation.

Because of these and other variations which will be apparent to those skilled in the art, the present invention is not intended to be limited to the particular embodiments described above. The scope of the invention is defined in the following claims.

What is claimed is:

1. A method of recovering shale oil from a subterranean formation containing oil shale which comprises the steps of;

(a) excavating a void in such a subterranean formation leaving upper and lower zones of unfragmented formation, each zone of unfragmented formation having a substantially horizontal free face adjoining the void, and leaving at least one support pillar of unfragmented formation, each such support pillar meeting each zone of unfragmented formation at a juncture of such a pillar and such a zone of unfragmented formation;

(b) placing explosive in the upper and lower zones of unfragmented formation for explosively expanding each of the zones toward the void;

(c) placing explosive in such pillar;

(d) detonating explosive in such pillar to fragment and explosively expand such pillar toward the void;

(e) expanding the upper and lower zones of unfragmented formation toward the void to form a fragmented permeable mass of formation particles containing oil shale in an in situ oil shale retort by detonating explosive in the upper and lower zones of unfragmented formation after detonating explosive in such pillar with a time delay sufficient for creation of a free face at each such juncture of such pillar and such zone of unfragmented formation owing to explosive expansion of such pillar;

(f) introducing gas to the fragmented permeable mass in the in situ oil shale retort for establishing a retorting zone in the fragmented permeable mass wherein oil shale is retorted to produce gaseous and liquid products, and advancing the retorting zone through the fragmented mass; and (g) withdrawing such gaseous and liquid products from the retort.

2. A method as recited in claim 1 in which sufficient explosive is placed in such a pillar to fragment and explosively expand substantially all of the pillar to have an average void fraction at least as great as the average void fraction in the fragmented permeable mass being formed.

3. A method as recited in claim 1 wherein the time between the detonation of explosive in such a pillar and the detonation of explosive in such a zone of unfragmented formation is more than the time required for creation of free face at a juncture of such a pillar and such a zone of unfragmented formation owing to explosive expansion of the pillar.

4. A method as recited in claim 1 in which the time between the detonation of explosive in such a pillar and the detonation of explosive in such a zone of unfragmented formation is sufficient for fragments formed by explosive expansion of such pillar to spread substantially uniformly across the void.

5. A method as recited in claim 1 in which the time between the detonation of explosive in such a pillar and the detonation of explosive in such a zone of unfragmented formation is no more than the time required for the pillar to expand sufficiently to have an average void fraction no more than about the average void fraction in the fragmented permeable mass being formed.

6. A method as recited in claim 1 in which explosive in the upper and lower zones of unfragmented formation is detonated before caving of the upper zone of unfragmented formation owing to explosive expansion of such a pillar.

7. A method as recited in claim 1 in which such a pillar has a substantially rectangular horizontal cross section and which comprises the step of forming at least one substantially horizontal blasting hole in such a pillar substantially parallel to the longer horizontal dimension of such a pillar and placing explosive in such a blasting hole.

8. A method for forming an in situ oil shale retort in a subterranean formation containing oil shale which comprises:

(a) excavating a void in a subterranean formation containing oil shale leaving a zone of unfragmented formation containing oil shale having a substantially horizontal free face adjoining the void and leaving at least one support pillar of unfragmented formation, such a support pillar meeting such a zone of unfragmented formation at a juncture of such a pillar and such a zone of unfragmented formation;

(b) placing explosive in such a zone of unfragmented formation for explosively expanding unfragmented formation adjacent the free face toward the void;

(c) placing explosive in such a pillar;

(d) detonating explosive in such a pillar for explosively expanding the pillar toward such a void; and (e) expanding at least a portion of such a zone of unfragmented formation toward such a void to form a fragmented permeable mass of formation particles containing oil shale in an in situ oil shale retort by detonating explosive in such a zone of unfragmented formation after detonating explosive in such a pillar and before a substantial portion of fragments formed by explosive expansion of the pillar come to rest.

9. A method as recited in claim 8 in which explosive in such a zone of unfragmented formation is detonated after a time delay sufficient for creation of free face at such a juncture of such a pillar and such a zone of unfragmented formation.

10. A method as recited in claim 9 in which the zone of unfragmented formation is below such a void and formation is expanded upwardly toward such a void.

11. A method as recited in claim 8 in which the zone of unfragmented formation is above such a void and the zone of unfragmented formation is expanded downwardly toward such a void.

12. A method as recited in claim 11 which comprises leaving a second zone of unfragmented formation containing oil shale below the void having a substantially horizontal free face adjoining the void, placing explosive in the second zone of unfragmented formation for explosively expanding unfragmented formation adjacent the free face of the second zone of unfragmented formation toward the void, and expanding at least a portion of the second zone of unfragmented formation upwardly toward the void.

13. A method as recited in claim 8 in which explosive in such a zone of unfragmented formation is detonated after a sufficient time delay that fragments formed by explosive expansion of the pillar can spread substantially uniformly across the void.

14. A method as recited in claim 8 in which sufficient explosive is placed in such a pillar to fragment and explosively expand substantially all of the pillar to have an average void fraction at least as great as the average void fraction in the fragmented permeable mass being formed.

15. A method as recited in claim 8 in which the time between the detonation of explosive in such a pillar and the detonation of explosive in such a zone of unfragmented formation is no more than the time required for the pillar to expand sufficiently to have an average void fraction no more than about the average void fraction in the fragmented permeable mass being formed.

16. A method as recited in claim 8 in which such a pillar has a substantially rectangular horizontal cross-section and which comprises the step of forming at least one substantially horizontal blasting hole in such a pillar substantially parallel to the longer horizontal dimension of such a pillar and placing explosive in such a blasting hole.

17. A method for fragmenting a zone of unfragmented subterranean formation adjacent a void having a substantially horizontal free face adjoining such a void, such a void containing at least one support pillar of unfragmented formation meeting the zone of unfragmented formation at a juncture of the pillar and the zone of unfragmented formation, which comprises:

(a) forming at least one blasting hole in such a zone of unfragmented formation adjacent the free face and placing explosive in such a blasting hole for expanding formation toward the void;

(b) forming at least one blasting hole in such a support pillar and placing explosive in such a blasting hole;

(c) explosively expanding at least a portion of such a zone of unfragmented formation toward the void to form a fragmented permeable mass of formation particles by detonating such explosive in single round of explosions by first detonating explosive in such a pillar and thereafter detonating explosive in such a zone of unfragmented formation with a time delay between detonation of explosive in the pillar and detonation of explosive in the zone of unfragmented formation sufficient for creation of a free face at the juncture of such a pillar and such a zone of unfragmented formation and less than the time required for a substantial portion of the particles formed by explosive expansion of the pillar to come to rest.

18. A method as recited in claim 17 in which the time delay between detonation of explosive in the pillar and detonation of explosive in the zone of unfragmented formation is sufficient for particles formed by explosive expansion of the pillar to spread substantially uniformly across the void.

19. A method as recited in claim 17 in which the time delay between detonation of explosive in the pillar and detonation of explosive in the zone of unfragmented formation is no greater than the time required for the pillar to expand sufficiently to have an average void fraction no more than about the average void fraction in the fragmented permeable mass being formed.

20. A method as recited in claim 17 in which sufficient explosive is placed in the pillar to fragment and explosively expand substantially all of the pillar to have an average void fraction at least as great as the average void fraction in the fragmented permeable mass being formed.

21. A method for forming an in situ oil shale retort in a subterranean formation containing oil shale which comprises:

(a) excavating a void in a subterranean formation containing oil shale leaving an upper zone of unfragmented formation and a lower zone of unfragmented formation, and leaving a plurality of support pillars of unfragmented formation extending between the upper and lower zones of unfragmented formation, each zone of unfragmented formation having a substantially horizontal free face adjoining the void, each support pillar meeting such a zone of unfragmented formation at a juncture of such a pillar and such a zone of unfragmented formation;

(b) forming a plurality of blasting holes in the upper zone of unfragmented formation;

(c) forming a plurality of blasting holes in the lower zone of unfragmented formation;

(d) forming at least one substantially horizontal blasting hole in each pillar;

(e) placing explosive in such a blasting hole in each pillar;

(f) placing explosive in the blasting holes in the upper and lower zones of unfragmented formation; and (g) detonating the explosive in the pillars and the zones of unfragmented formation in a single round of explosions with a time delay between detonation of explosive in such a pillar and detonation of explosive in the zones of unfragmented formation for first explosively expanding such pillar toward the void and then explosively expanding unfragmented formation in the upper and lower zones of unfragmented formation toward the void before a substantial portion of particles formed by explosive expansion of the pillar come to rest, to form a fragmented permeable mass of formation particles containing oil shale in an in situ oil shale retort.

22. A method as recited in claim 21 in which the time delay is sufficient for creation of free face at the juncture of such a pillar and the upper zone of unfragmented formation and also at the juncture of such a pillar and the lower zone of unfragmented formation.

23. A method as recited in claim 21 in which the time delay is sufficient for particles formed by explosive expansion of the pillars to spread substantially uniformly across the void.

24. A method as recited in claim 21 in which such a pillar has a substantially rectangular horizontal cross-section and which comprises the step of forming at least one blasting hole in such support pillar substantially parallel to the longer horizontal dimension of such a pillar.

25. A method as recited in claim 21 in which the time delay is no more than the time required for the pillars to expand sufficiently to have an average void fraction no more than the average void fraction in the fragmented permeable mass being formed.

26. A method of forming an in situ oil shale retort in a subterranean formation containing oil shale, the method comprising the steps of:

(a) excavating a void in a subterranean formation containing oil shale leaving an underlying zone of unfragmented formation containing oil shale having a substantially horizontal free face adjoining the void;

(b) leaving at least one support pillar of unfragmented formation in the void for supporting unfragmented formation above the void, such a pillar meeting the zone of unfragmented formation at a juncture;

(c) forming a plurality of blasting holes in the underlying zone of unfragmented formation;

(d) forming at least one blasting hole in such a pillar;

(e) placing explosive in such blasting holes in the underlying zone of unfragmented formation;

(f) placing explosive in such a blasting hole in such a pillar;

(g) detonating explosive in such a pillar for explosively expanding such a pillar toward the void; and (h) explosively expanding at least a portion of the zone of unfragmented formation upwardly toward the void by detonating explosive in the zone of unfragmented formation after detonating explosive in the pillar with a time delay sufficient for creation of free face at the juncture of such a pillar and the zone of unfragmented formation to form a permeable mass of formation particles containing oil shale in an in situ oil shale retort.

27. A method as recited in claim 26 in which explosive in the zone of unfragmented formation is detonated after a time delay sufficient for particles formed by explosive expansion of such a pillar to spread substantially uniformly across the void.

28. A method as recited in claim 26 in which explosive in the zone of unfragmented formation is detonated after a time delay no more than the time required for the pillar to expand sufficiently to have an average void fraction no more than the average void fraction in the fragmented permeable mass being formed.

29. A method of forming an in situ oil shale retort in a subterranean formation containing oil shale, the method comprising the steps of:

(a) excavating a void in a subterranean formation containing oil shale leaving an overlying zone of unfragmented formation containing oil shale having a substantially horizontal free face adjoining the void;

(b) leaving at least one support pillar of unfragmented formation in the void for supporting overlying unfragmented formation;

(c) forming a plurality of blasting holes in the overlying zone of unfragmented formation;

(d) forming at least one blasting hole in such a pillar;

(e) placing explosive in such blasting holes in the overlying zone of unfragmented formation;

(f) placing explosive in such a blasting hole in such a pillar;

(g) detonating explosive in such a pillar for explosively expanding such a pillar toward the void;

(h) explosively expanding at least a portion of the overlying zone of unfragmented formation downwardly toward the void by detonating explosive in the overlying zone of unfragmented formation after detonating explosive in the pillar with a time delay less than the time required for a substantial portion of particles formed by explosive expansion of such a pillar come to rest, to form a fragmented permeable mass of formation particles containing oil shale in an in situ oil shale retort.

30. A method as recited in claim 29 in which explosive in the zone of unfragmented formation is detonated after a time delay sufficient for particles formed by explosive expansion of such a pillar to spread substantially uniformly across the void.

31. A method as recited in claim 29 in which explosive in the zone of unfragmented formation is detonated after a time delay no more than the time required for the pillar to expand sufficiently to have an average void fraction no more than the average void fraction in the fragmented permeable mass being formed.

* * * * *